US005519165A

United States Patent [19]

Gregory

[11] Patent Number: 5,519,165

[45] Date of Patent: May 21, 1996

[54] COMPOUND HEADSTOCK FOR A STRINGED INSTRUMENT

[76] Inventor: Alex Gregory, 13612 Burbank Blvd., #1, Van Nuys, Calif. 91401

[21] Appl. No.: 893,232

[22] Filed: Jun. 3, 1992

[51] Int. Cl.[6] ..... G10D 3/00

[52] U.S. Cl. ..... 84/293; 84/267

[58] Field of Search ..... 84/293, 267, 268, 84/269, 314 R, 314 N, 303, 304, 305

[56] References Cited

U.S. PATENT DOCUMENTS

| | | | |
|---|---|---|---|
| 4,213,370 | 7/1980 | Jones | 84/293 |
| 5,097,737 | 3/1992 | Uhrig | 84/314 N |
| 5,175,387 | 12/1992 | Greory | 84/314 N |

*Primary Examiner*—Michael L. Gellner
*Assistant Examiner*—Cassandra Spyrou

[57] ABSTRACT

A compound headstock for use with a guitar-like instrument. The headstock has a major surface to which posts of a majority of the headmachines mounted on the headstock project. The headstock also preferably incudes first and second surfaces disposed at elevations different than the elevation of the major surface. Through the first and second surfaces are disposed the posts of headmachines associated with the lowest and highest tuned strings used on the guitar-like instrument. As such, the string associated with the lowest tuned note makes an angle with respect to the plane in which the strings set between a nut on the guitar-like instrument and a bridge on a guitar-like instrument which is much greater than the angles made for the majority of the strings. Similarly, the string associated with the highest tuned note makes an angle with respect to said plane which is much less than the angles associated with the stings associated with the majority of the headmachines.

11 Claims, 6 Drawing Sheets

COMPOUND HEADSTOCK FOR A STRINGED INSTRUMENT

FIELD OF THE INVENTION

The present invention relates to stringed instruments, particularly to guitar-like instruments.

BACKGROUND OF THE INVENTION

In the history of stringed instruments, many instruments are known having more than the six strings found on a traditional Spanish-style guitar. Even guitars have been known to have more than six strings, such as the Ramirez ten string classical guitar built for Narciso Yepes. However, such guitars have been highly unusual and invariably strung with nylon strings. Also, when guitars have had more than six strings they have invariably followed a different tuning pattern from the standard guitar of today which is from low to high, E, A, D, G , B, and E.

With the subsequent advent of the electric guitar, some rare examples of steel strung guitars having more than six strings tuned to different notes became known. For examples, the Gretsch Van Eps model which had seven strings, with a B string added to the lower end of the conventional six string guitar tuning. This guitar was designed so that musicians could imitate the bass walking line of a double bass in a Be-Bop context. The guitar had amplified pick-ups and the steel strings vibrating within the magnetic domain of the pick-ups caused the pick-ups to put out an electrical signal indicative of the vibrating string. In this prior art guitar, the pick-ups had to be set up so that they did not distort the sound of the vibrating strings since any note below a low D, when distorted, becomes incredibly muddy and unpleasant sounding. The low B string also tended to rattle at the nut, but the Gretsch Van Eps model was in fact a fine guitar when played cleanly and even the rattling of the low B string was almost in character with the mild slapping technique of a jazz bass popular at that particular time in our music history.

Although string instruments having more than six strings are well known, when it comes to guitars, they have typically been limited to six-string (or six pairs of strings, as in the case of a twelve-string guitar). As indicated above, the Gretsch Van Eps model guitar was a seven-string electric guitar with an added low B string. In 1988, Alex Gregory, the inventor named herein, developed a new electric seven-string guitar which has an added top A metal string as opposed to an added low B string to the standard guitar tuning. A high A metal string, because it is so thin, had a tendency to break in use in the prior art, but Alex Gregory, the inventor of the present invention, developed a seven string guitar which overcame the breakage problem theretofore associated with the top A string. These developments are the subject of Alex Gregory's U.S. patent applications Ser. Nos. 436,559; 636,503 and 636,416 filed Nov. 1, 1989 and Dec. 31, 1990, the disclosures of which are incorporated herein by this reference. The techniques which Alex Gregory used to overcome the string breakage problem included the use of unorthodox staggered headmachines which would adjust the individual tension of each string over a straight headstock. The seven string guitar works very well and has been sold in the past by Hamer Guitars and will be marketed in the future by Fender Musical Instruments.

In today's modern music, rock music is influencing and being influenced by both classical and country music to a greater extent than heretofore known. This sort of influence has made it desirable to be able to play violin influenced music on an electrical guitar. The conventional six string Spanish-style guitar does not satisfy this need because it cannot play a sufficiently wide range of notes due to its limitation of six strings. However, adding additional strings to a guitar type instrument in order to give it a wider range of notes is not a simple matter. As indicated above, the addition of a top A string led to string breakage problems which was only recently solved by Alex Gregory by the invention noted above. The addition of a low B string, which was previously done on the Gretsch Van Eps model guitar, leads to a string which tends to rattle and while that rattling string might be in character with certain types of jazz music, it is not in character or desirable in the current text of classical violin pieces, classical piano pieces, or even modern rock pieces influenced by classical music.

The present invention provides a guitar type instrument having eight strings, the six middle strings being tuned to the standard guitar tuning with an added high A string and an added low B string. The present invention presents additional ways of overcoming the breakage of the high A string first addressed by Alex Gregory as noted above, and also teaches how the low B string can be kept from rattling.

The guitar-like instrument of the present invention should be played cleanly, that is without its pick-ups going into distortion, because the low B string, when distorted, still sounds muddy. However, given the fact that the guitar-like instrument of the present invention can be used to play classical piano pieces and since the piano itself is not a distorted instrument, playing the guitar-like instrument of the present invention cleanly (without distortion) is completely consistent with this type of music. Therefore, the strings on the present guitar-like instrument are tuned B, E, A, D, G, B, E, A, from low to high. The strings are preferably metal (so they can be picked up and amplified) and the scale length is preferably the more or less standard 25½" scale length which is very popular in modern guitars.

In order to overcome the string breakage problem, in the case of the high A string, and the string rattling problem, in the case of the low B string, these strings are preferably tilted toward the headstock approximately 2°, in the case of the high A string, and 22° in the case of the low B string, from the plane in which the strings normally are disposed between the nut of the guitar and the bridge of the guitar. The remaining strings, mainly the six strings found on conventional guitars, are preferably tilted back 9° to 14° and preferably 12° from the plane in which the strings normally sit.

The compound headstock of the present invention permits the low B string to exit the nut at a relatively steep angle of 22° but at the same time permits the high A string to exit the nut at a very modest angle of only 2°. This is done by providing a headstock which has a major front and back surface for mounting the tuning machines associated with the six strings which are tuned to the standard tuning of a six string electrical guitar but having a compound surface so that different front and back surfaces are provided for mounting the string machine associated with low B strings and providing still different front and rear surfaces for mounting the string machine associated with the high A string. Thus, instead of mounting all of the headmachines on a uniform surface, such as done in the prior art, the compound headstock of the present invention provides surfaces at different levels for mounting the headmachines so as to accommodate the different angles which the strings exiting the nut toward the headmachines should have in order to overcome the problems discussed above.

SUMMARY OF THE INVENTION

In general terms, the present invention provides a guitar-like instrument having a body, upon which a string bridge is installed, an elongated neck attached to said body, and a headstock fixed to said neck remote from said body. The headstock has a plurality of head machines disposed thereon. A nut is disposed on the neck adjacent the head stock and means are provided for adjusting the locations of posts associated with the headmachines such as the strings take predetermined angles with respect to a plane in which the strings generally reside between the nut and the bridge.

The string which is tuned to the lowest note takes approximately a 22° angle to the plane between the nut and the post of its associated headmachine. The string associated with the highest note takes approximately a 2° angle to the plane between the nut and the post of its associated headmachine while the remaining strings take angle generally with the range of 9° to 14° to the plane between the nut and the post of their associated headmachines.

BRIEF DESCRIPTION OF THE DRAWINGS

FIGS. 2-1, 2—2, 2–3 and 2–4 are side views of a portion of the neck and headstock of the guitar-like instrument of FIG. 1;

FIG. 3 is a detailed plan view of the headstock;

FIG. 4 is a detailed rear view of an alternate embodiment of the headstock;

DETAILED DESCRIPTION

Figure 1:
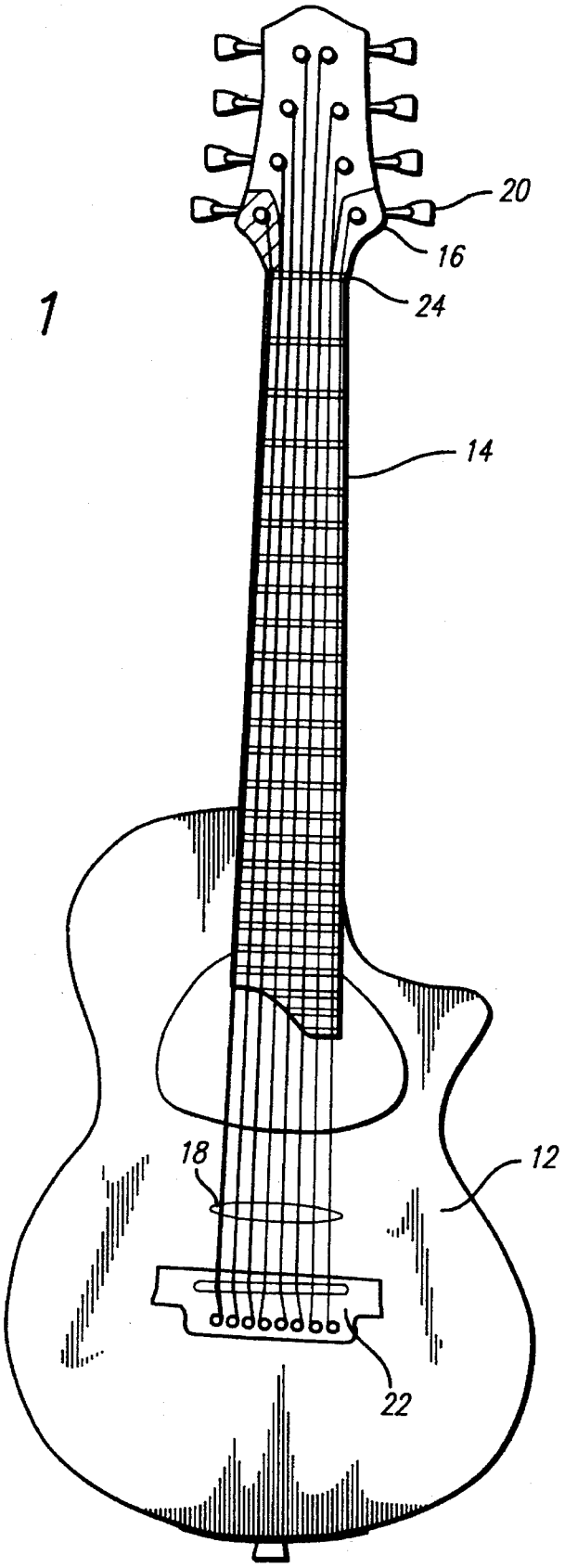
FIG. 1 is a plan view of one embodiment of a stringed instrument.
Figure 2A:
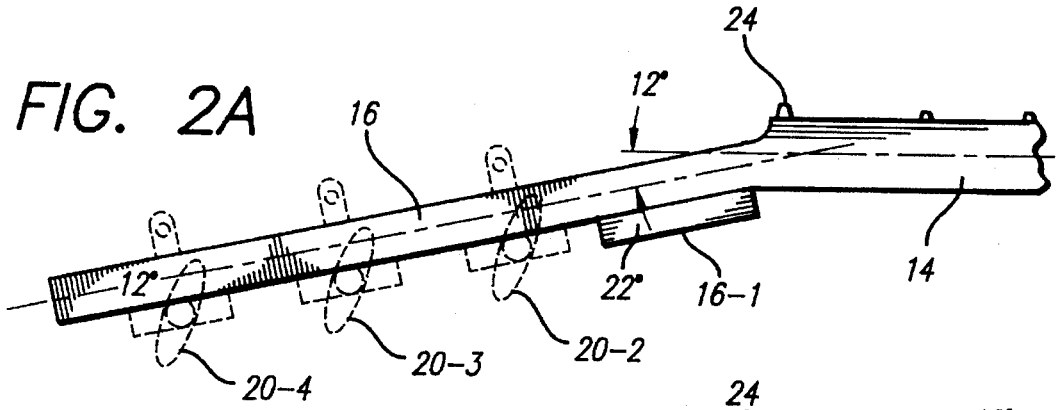
Figure 2B:
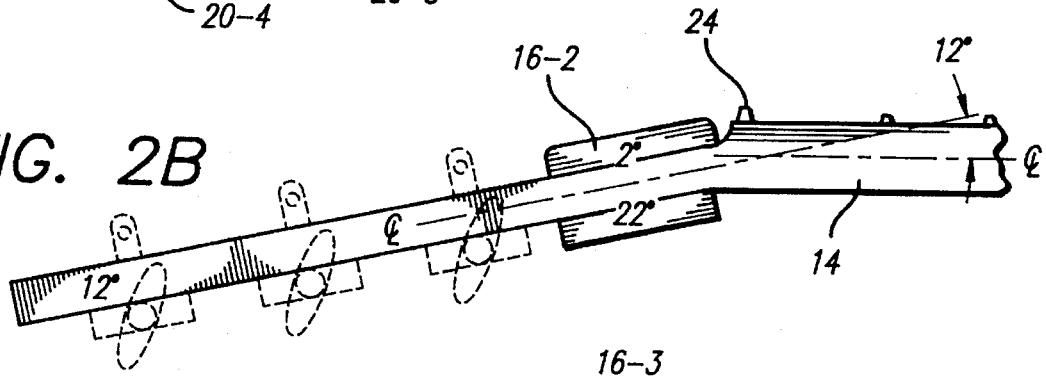
Figure 2C:
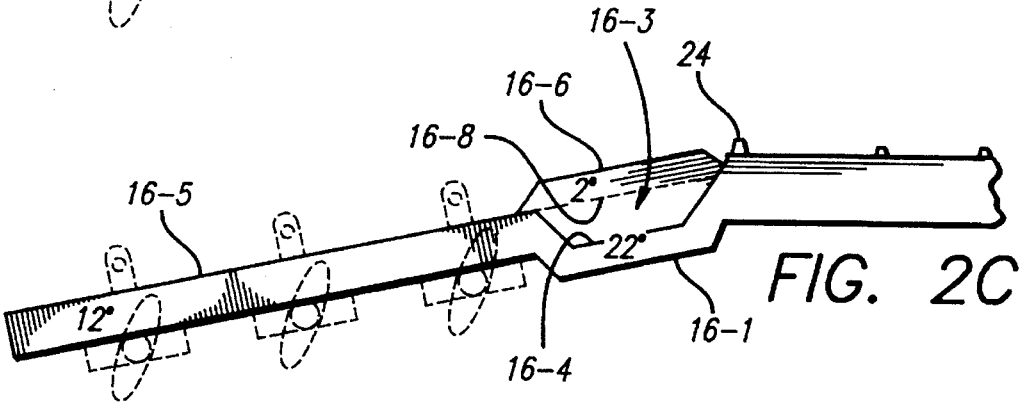
Figure 2D:
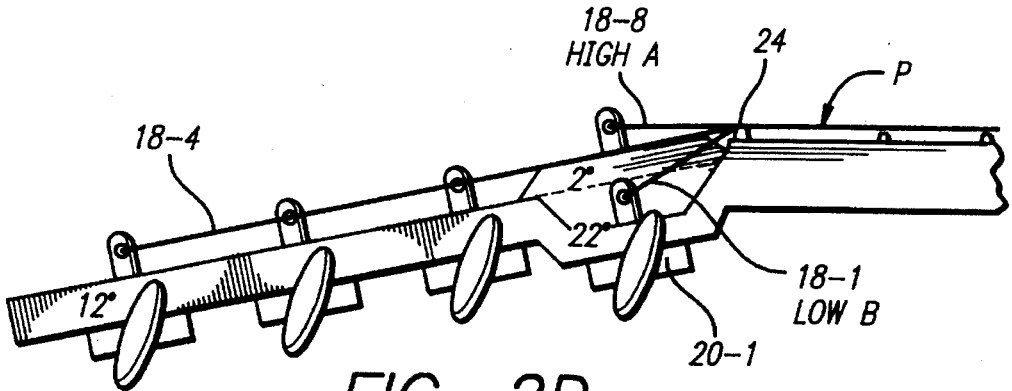

FIG. 1 is a plan view of a stringed instrument having eight strings, the instrument generally taking the shape of an electric guitar. The instrument has a body 12, which may be made of solid wood or which may have one or more resonating cavities therein. Attached to the body is a neck 14, and at the distal end of the neck is a headstock 16. Strings 18 are strung between headmachines 20, installed on the headstock 16, and a bridge, which may be a vibrato bridge 22 of a type well known in the prior art. I prefer to use a piezo electric saddle combination bridge, available from Lloyd Baggs, for example. That bridge produces a very piano-like, clean sound. The strings 18, when strung, vibrate between a nut 24, and bridge 22. The strings are preferably metal, since metal strings permit the neck to be narrower than it could be if nylon or other non-metallic strings were used.

Turning now to FIGS. 2-1 through 2–4, these figures comprise side views of a portion of the neck 18 and the headstock 16. For clarity, the construction of the headstock is shown in four steps which are associated with FIGS. 2-1 through 2–4.

Figure 3:
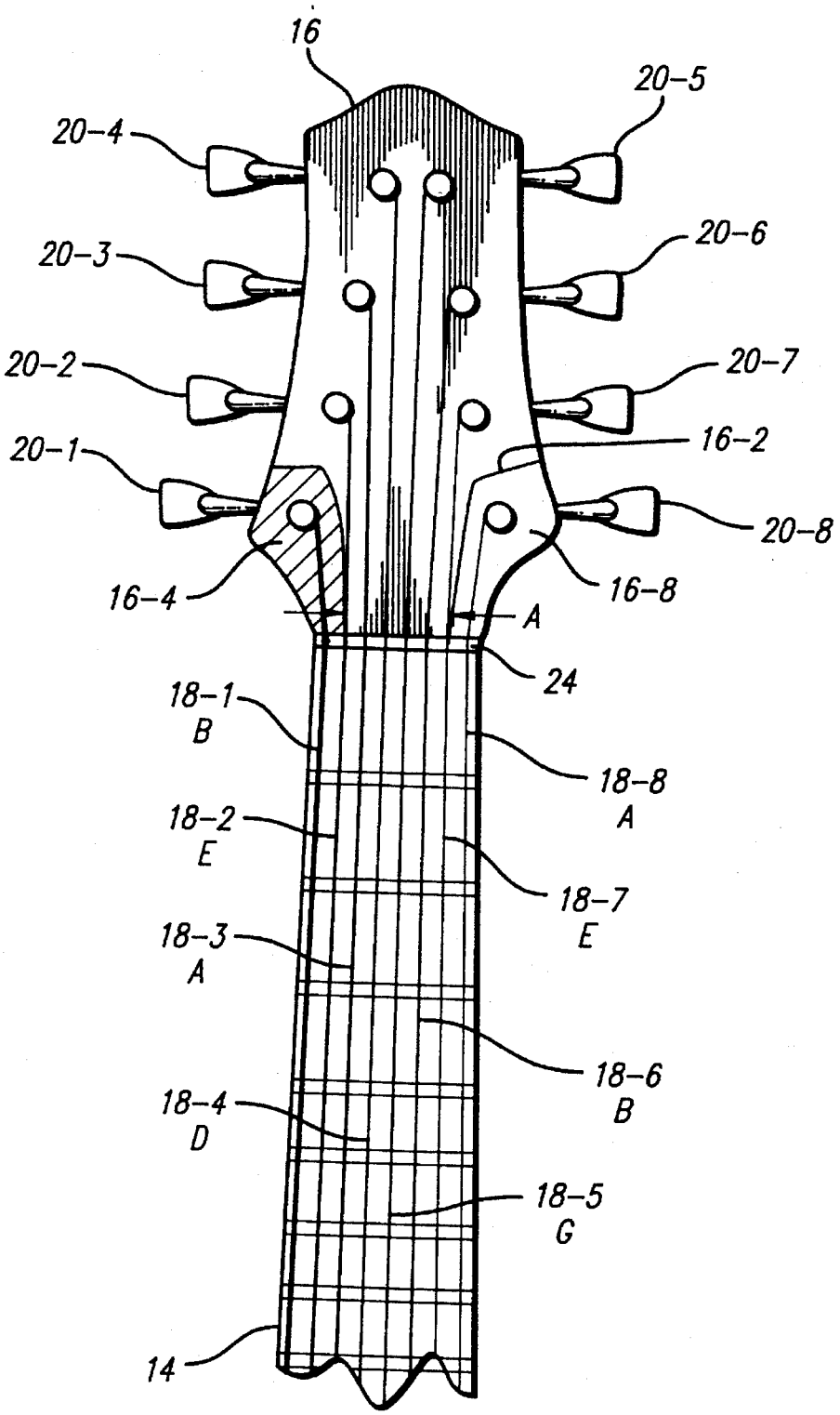

FIG. 3 is a detailed plan view of the headstock 16 and a portion of neck 14. In order to identify particular headmachines 20, they are identified with the second numeral following a dash, that is, as headmachines 20-1 through 20-8, in order from the headmachine associated with the lowest tuned string (headmachine 20-1) to the headmachine associated with the highest tuned string (headmachine 20-8).

In FIGS. 2-1 through 2–3 headmachines 20-2 through 20-4 are shown in phantom lines so as to demonstrate their eventual location on the headstock 16.

Considering now FIG. 2-1, the center line of the headstock is disposed at approximately a 12° angle with respect to the center line of the guitar neck 14. Those skilled in the art realize that guitar necks are typically made of wood and they also typically include a slightly bowed metal truss rod inside the guitar neck (not shown) which is put into tension to keep the guitar neck from bending too much in response to the tensioning of the strings 18. Since such constructional details are well known in the art, they will not be discussed in further detail here. In FIG. 2-1 a block of wood 16-1 is shown affixed to the underside of headstock 16 in the area where headmachine 20-1 will ultimately be affixed. In FIG. 2—2 another wood block, identified by the reference number 2, is attached to the top side of headstock 16, but instead of being in the vicinity of where headmachine 20-1 will be eventually installed, it is instead disposed on the far side of headstock 16 (as viewed in FIG. 2—2), as can be more clearly seen in FIG. 3 that is, where headmachine 20-8 will eventually be located. Blocks 16-1 and 16-2 may be attached to headstock 16 by means of an appropriate wood adhesive or may be fashioned from the same common piece of wood that headstock 16 is fashioned, as desired.

Figure 4:
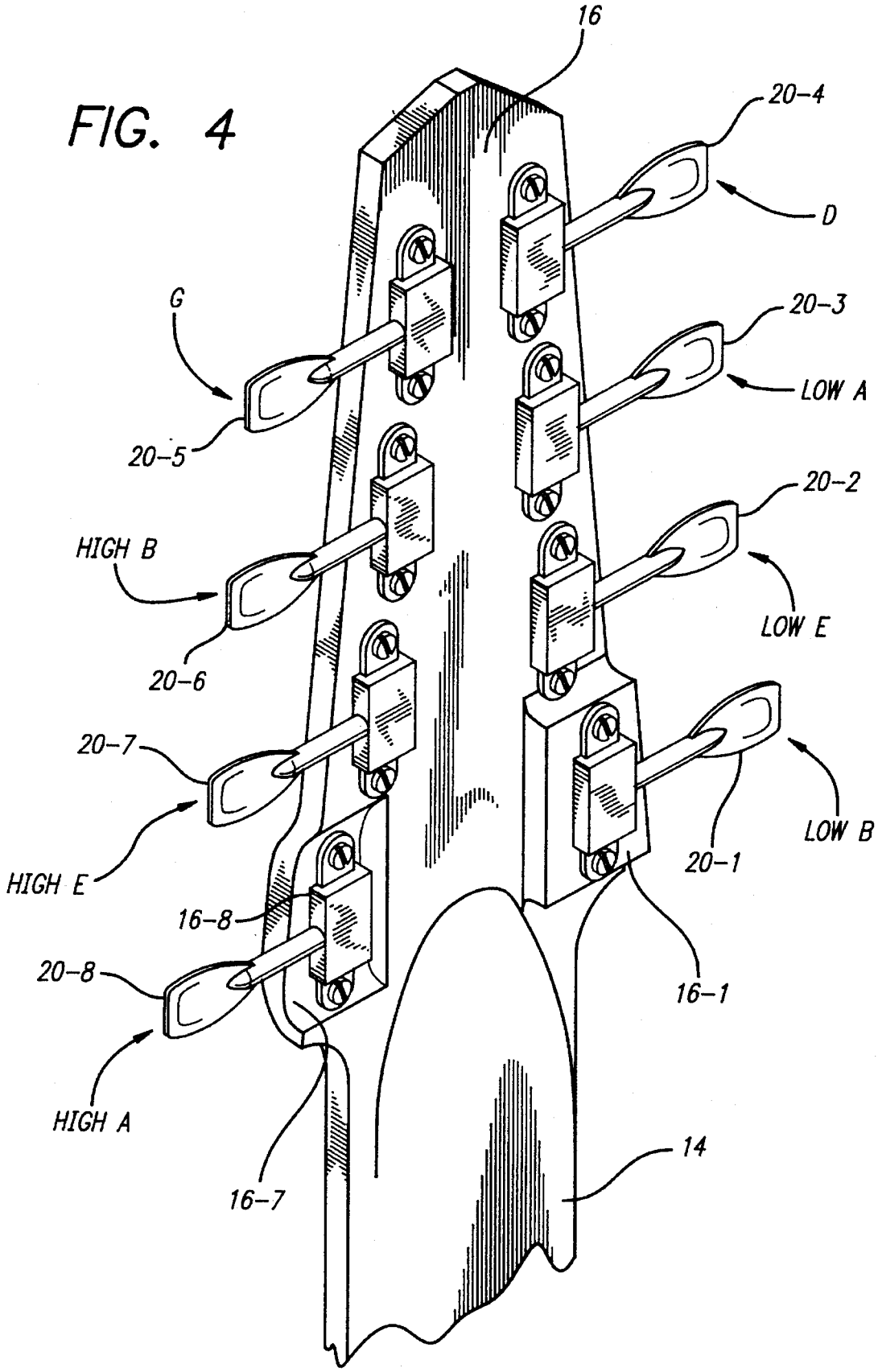

The wood blocks are shaped as indicated in FIG. 2–3 and, moreover, a portion 16-3 of headstock 16, is cut away so as to define a surface 16-4 which is spaced an appropriate distance below the major top surface 16-5 of headstock 16. The top surface 16-6 of block 16-2 provides a surface which is spaced an appropriate distance above surface 16-5 of headstock 16. Just as portion 16-3 is machined out on the front side of headstock 16 to form surface 16-4, on the back side of the headstock, as can be seen in FIG. 4, which is a somewhat modified version of the headstock, a portion of headstock 16 is machined away as can be seen at numeral 16-7 to define a surface 16-8 which is the surface to which headmachine 20-8 is installed. Headmachine 20-1 is installed on surface 16-1.

Turning now to FIG. 2–4, this side view of the headstock 16 is shown with the headmachines installed and with strings 18 in place, which strings are individually numbered 18-1 through 18-8, that is with the same nomenclature as used with respect to the headmachines 20. Thus, in FIG. 2–4, string 18-1 exits nut 24 and is wound on the post of headmachine 20-1. Similarly, strings 18-2 through 18-8 are wound on the posts of their associated headmachines 20-2 through 20-8. Of course, not all of the headmachines and strings can be seen in FIG. 2–4 since headmachines 20-5 through 20-7 are hidden by headmachines 20-4 through 20-2.

The height of the posts of headmachines 20-2 through 20-7 above surface 16-5 is selected so that the associated strings 18-2 through 18-7 are disposed at approximately a 12° angle from a plane P in which the strings normally reside between nut 24 and bridge 22. While I find a 12° angle to work well, the individual strings may be at slightly different angles and so long as the strings are at an angle generally in the range of 9° to 14° they should work properly.

With respect to string 18-1, it is the low B string which has had a tendency to rattle in the prior art. In order to overcome this rattling, I dispose that low B string, namely string 18-1, at approximately a 22° angle between nut 24 and headmachine 20-1 compared to plane P of the strings between nut 24 and bridge 22. By disposing the top surface 16-4 of the cut away area 16-3 at an appropriate distance below surface 16-5 so as to yield the approximately 22° angle discussed above, the rattling of the low B string which occurred in the prior art is avoided.

String 18-8 instead of being disposed at a 12° angle to plane P, is preferably disposed at a 2° angle to plane P. Of course, one way of attaining that 2° angle would have been to use a headmachine 20-8 with a longer post so as to reduce the angle of string 18-8 from the normal 12° angle with respect to plane P to 2°. However, that results in a post which is quite long and since the post itself, due to its increased length then has more flexibility than does a shorter post, that increased flexibility reduces the capability of the post to transmit vibrations to headstock 16. Therefore I find it preferable to use a headmachine 20-8 which has a relatively short post length, but which is installed on surface 16-8, and thus its post projects from a surface 16-6 spaced an appropriate distance above surface 16-5 so as to yield the approximate 2° inclination of string 18-8 between nut 24 and headmachine 20-8 compared to the plane P. By reducing the bend of string 18-8 at nut 24 to only a 2° bend from plane P, the breakage problem associated with high A strings known in the prior art is overcome.

In FIG. 3, wood blocks 16-1 and 16-2 may be separated in the plan view preferably by a distance "A" so as to provide access for adjusting the truss rod typically disposed in the neck portion of the guitar, which is used, as discussed above, to keep the neck from bending against the tension of the strings 18. Alternatively, other means for adjusting the truss rod may be employed. However, the separation is usual for both ascetic reasons and to provide a path for string 18. Those skilled in the art will appreciate that instead of employing separate blocks 16-1 and 16-2, that the headstock 16, including surfaces 16-4, 16-6 and 16-8 can instead be manufactured from a single piece of wood, using, for example, computer controlled milling techniques known in the art.

Figure 5:
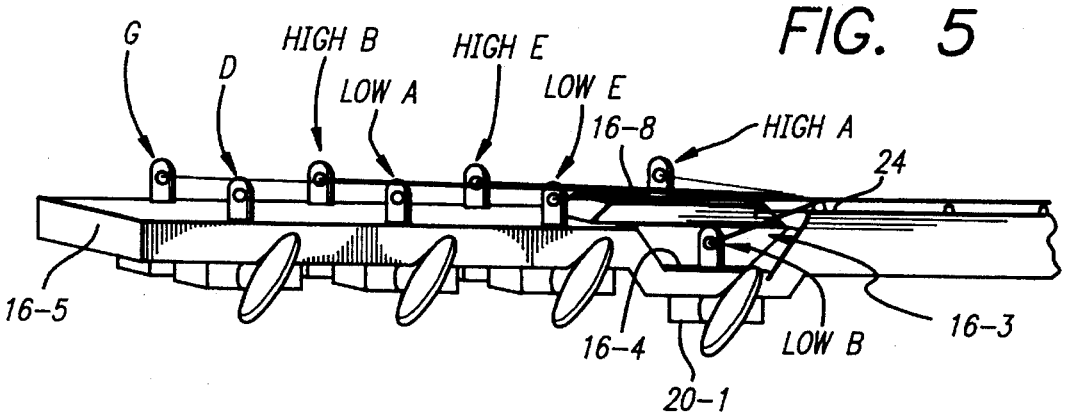
FIG. 5 is a side view of the headstock showing a second embodiment of my invention.
Figure 6:
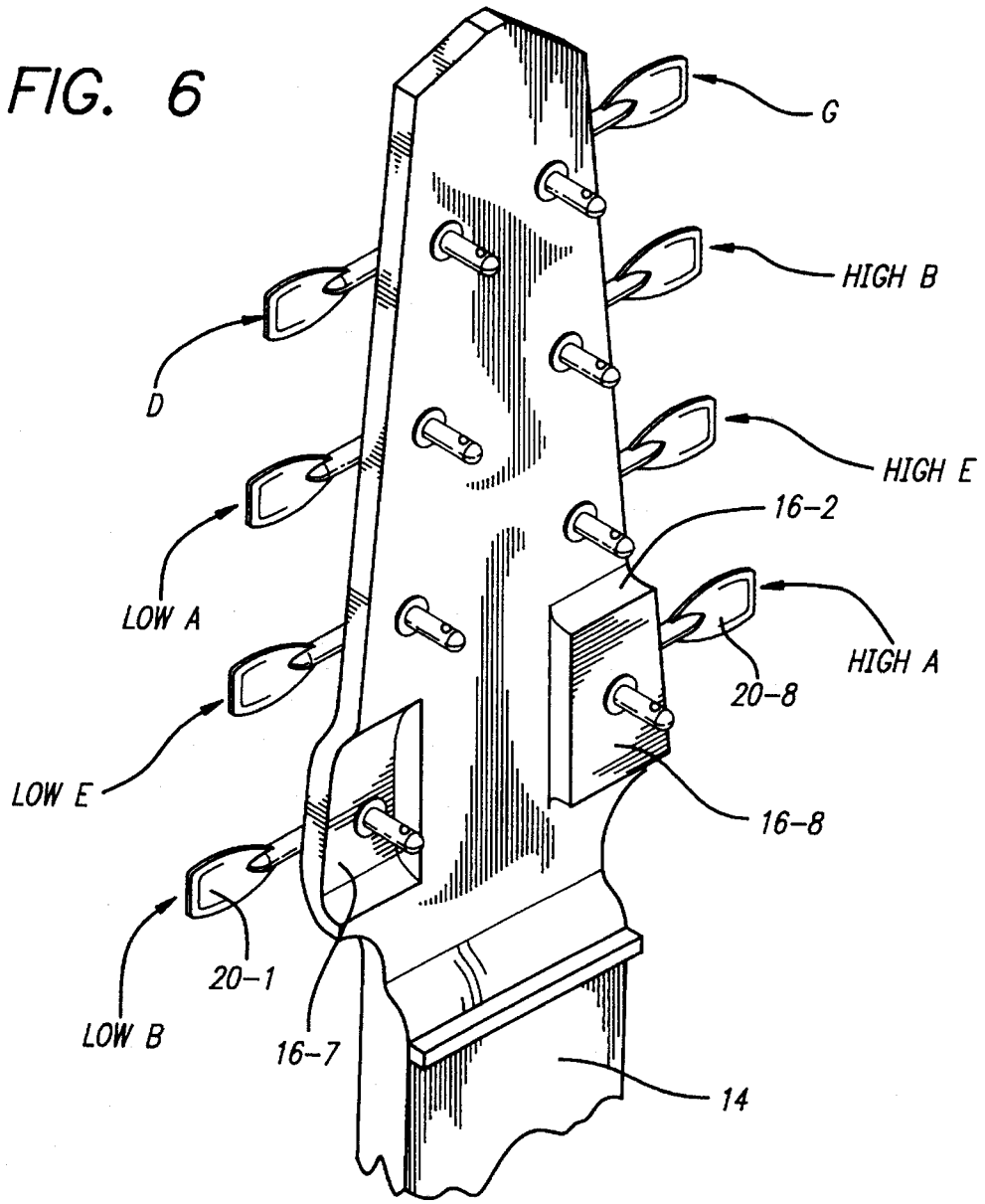
FIG. 6 is a front perspective view of the headstock of FIG. 5.

Turning now to FIGS. 5 and 6, these figures depict side and rear views of a second embodiment of the guitar headstock 16. In this embodiment, the center line of the headstock 16 is disposed parallel to the center line of the neck 18. In FIGS. 5 and 6 elements are defined by the same element numbers as are used in FIGS. 1 through 4.

In order to maintain strings 18-2 through 18-7 at approximately a 12° from plane P the posts headmachines 20-2 through 20-7 have varying heights as can be seen in FIG. 5. The post of headmachine 20-1 projects from a surface 16-4 in the scooped out area 16-3 while the post of headmachine 20-8 projects from a surface 16-8 which is disposed at a height above 16-5. The height of surface 16-8 above surface 16-5 and the height of surface 16-4 below 16-5 are selected such that the string 18-1 is bent at approximately a 22° from the plane of the strings nut 24 and the post of headmachine 20-1 while string 18-8 is bent at only approximately a 2° angle between nut 24 and the post of headmachine 20-8.

Figure 7:
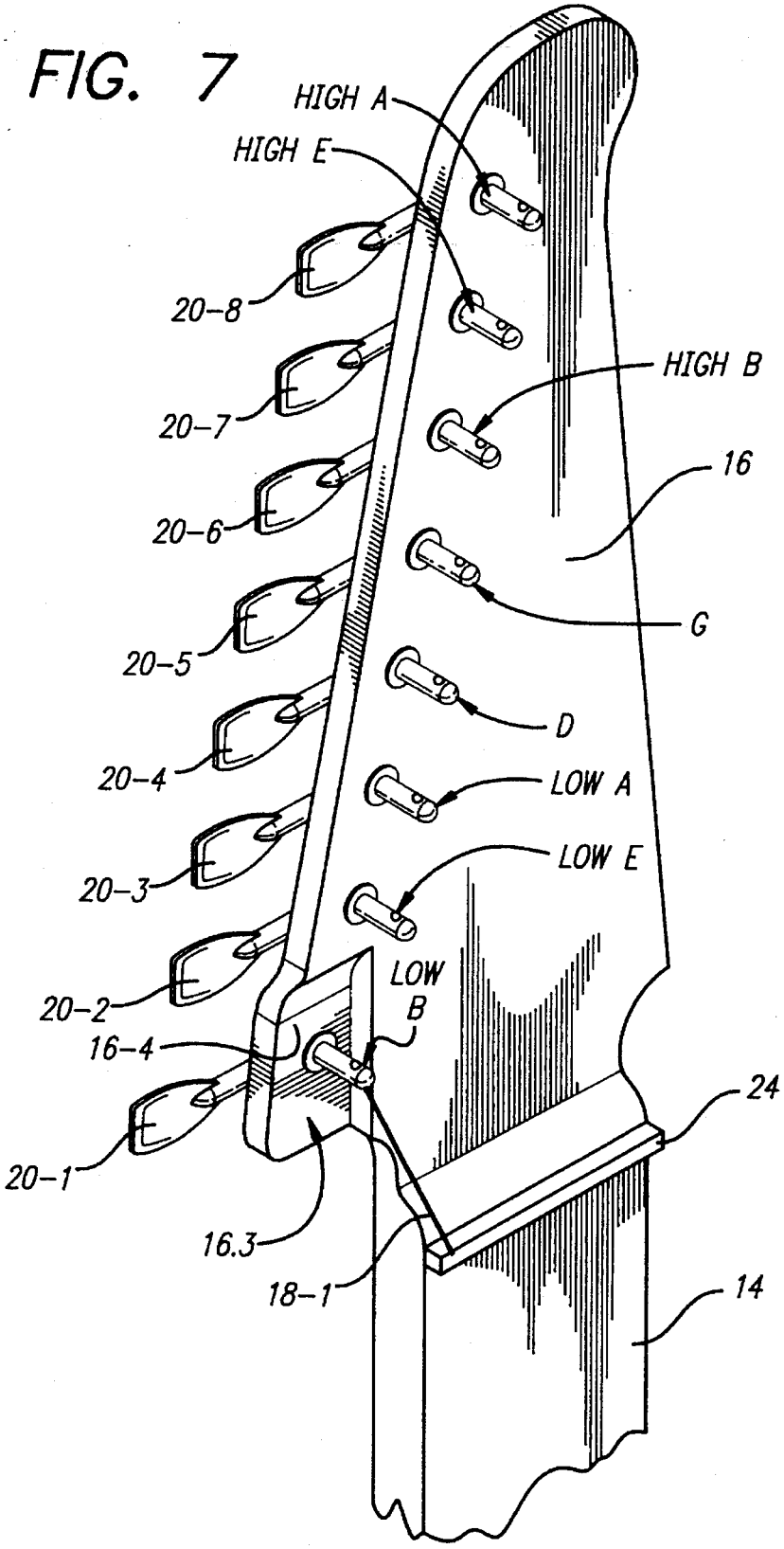
FIG. 7 is a front prospective view of the headstock of a third embodiment of my invention.

A third embodiment of the invention is shown in FIG. 7. As in the case of the prior figures, the same figure numbers are used to refer to similar components. In this embodiment, the headmachines are all arranged on one side of the headstock 16 and headmachine 20-1 is installed beneath the scooped out area 16-3 such that its post projects from the surface 16-4 again so that string 18-1 is disposed at approximately the same 22° angle as shown in FIG. 5 with reference to the plane in which the strings occupy between nut 24 and bridge 22.

In this embodiment, it is not necessary to have both headmachine 20-8 project from a raised platform such as is defined by surface 16-8 in FIGS. 1 through 6 since the further away the headmachine is from nut 24, the smaller the angle which the string would normally make from nut 24 to the post of the associated headmachine. Of course, as disclosed in my prior U.S. patent application Ser. No. 636,503, filed Dec. 31, 1990, the height of the various headmachine should be adjusted so that the angle which strings 18-2 through 18-7 make with reference to the nut will preferably fall in the range of 9° to 14° while the height of the post associated with headmachine 20-8 should be selected so that angle is only approximately 2° in the case of the high A string (string 18-8).

In all the forgoing embodiments, strings 20-1 through 20-8 will be tuned to the notes of B, E, A, B, G, D, E, and A from low to high. Strings 18-2 through 18-7 thus assume a conventional guitar tuning, while string 20-1 is for a lower B string while string 20-8 is for a higher A string. The strings are preferably made of metal.

I presently prefer the first embodiment described herein, namely the embodiment of FIGS. 1 through 3. I believe that all the embodiments will function very well with respect to keeping the low B string (string 18-1) from rattling and keeping the high A string (string 18-8) from breaking. However, given the fact that this guitar can be used to play piano type music, especially piano pieces written for classical music or for rock music which have classical interludes, I prefer the first embodiment as the tilted headstock of that embodiment looks more like the classical tilted headstock found on classical guitars than does the straight headstock of the embodiment of FIGS. 5 and 6 or the embodiment of FIG. 7. Thus, my preference is based upon aesthetics as opposed to functional considerations.

Having described my invention with respect to certain embodiments thereof, modification may now suggest itself to those skilled in the art. The invention is not to be limited to the embodiments disclosed except as required by the amended claims.

What is claimed:

1. A compound headstock for a stringed musical instrument comprising:

a plurality of headmachines each having a post;

a headstock surface;

means for mounting said plurality of headmachines on said headstock with each said post projecting from the headstock surface;

said headstock surface having a major surface and a first surface, said major surface including a majority of said headmachines, said first surface including one of said plurality of said headmachines, and said major surface and said first surface being not co-planar.

2. The compound headstock of claim 1, wherein said headstock surface further has a second surface in a second plane, said second surface including another one of said plurality of said headmachines, and wherein said second surface is not co-planar with either of said major surface and said first surface.

3. The compound headstock of claim 2, wherein said first and second surfaces are spaced predetermined distances from said major surface.

4. The compound headstock of claim 3 wherein said first surface is spaced in a first direction away from said major surface and said second surface is spaced in a second direction away from said major surface.

5. A stringed musical instrument comprising:

a body;

a bridge mounted on said body;

an elongated neck having a first and second end, said neck being mounted to said body at said first end;

a headstock having a headstock surface mounted to said neck at said second end;

a plurality of headmachines each having a post;

means for mounting said plurality of headmachines on said headstock with each said post projecting from the headstock surface;

said headstock surface having a major surface in a plane and a first surface in a first plane, said major surface including a majority of said headmachines, said first surface including one of said plurality of said headmachines and said major surface and said first surface being not co-planar.

6. The instrument according to claim 5 further comprising:

a bridge mounted on said body;

a nut mounted on said neck;

a plurality of strings, each of said strings being secured to said bridge and extending across said nut to thereby form a string plane and further being secured to a respective one of said posts of said headmachines;

said first plane being disposed such that the string between the nut and secured to said post of said one of said headmachines forms an angle of about 2° to the string plane.

7. The instrument according to claim 8, wherein said major plane is disposed such that the strings between the nut and secured to said majority of said headmachines form an angle in range of 9° to 14° to the string plane.

8. The instrument according to claim 6, wherein said headstock surface further has a second surface in a second plane, said second surface including another one of said plurality of headmachines, said second plane being disposed such that the string between the nut and secured to said post of said another one of said headmachines forms an angle of about 22° to the string plane.

9. The instrument according to claim 5 further comprising:

a bridge mounted on said body;

a nut mounted on said neck;

a plurality of strings, each of said strings being secured to said bridge and extending across said nut forming a string plane and further being secured to a respective one of said posts of said headmachines;

said first plane being disposed such that the string between the nut and secured to said post of said one of said headmachines forms an angle of about 22° to the string plane.

10. The instrument according to claim 9, wherein said major plane is disposed such that the strings between the nut and secured to said posts of said majority of said headmachines form an angle in range of 9° to 14° to the string plane.

11. The instrument according to claim 10, wherein said headstock surface further has a second surface in a second plane, said second surface including another one of said plurality of headmachines, said second plane being disposed such that the string between the nut and secured to said post of said another one of said headmachines forms an angle of about 2° to the string plane.

* * * * *